US006193742B1

(12) United States Patent
Moriarty

(10) Patent No.: US 6,193,742 B1
(45) Date of Patent: Feb. 27, 2001

(54) PACIFIER WITH MOTION/SOUND GENERATOR

(76) Inventor: David J. Moriarty, 22011 Alger, St. Clair Shores, MI (US) 48080

( * ) Notice: Subject to any disclaimer, the term of this patent is extended or adjusted under 35 U.S.C. 154(b) by 0 days.

(21) Appl. No.: 08/966,328

(22) Filed: Nov. 7, 1997

(51) Int. Cl.[7] ..... A61J 17/00
(52) U.S. Cl. ..... 606/234; 606/234
(58) Field of Search ..... 606/234, 235, 606/236

(56) References Cited

U.S. PATENT DOCUMENTS

| | | | |
|---|---|---|---|
| 1,586,499 | 5/1926 | Worth . | |
| 3,115,139 | * 12/1963 | Schneider | 606/235 |
| 3,283,758 | 11/1966 | Killebrew . | |
| 4,554,919 | 11/1985 | Hubert . | |
| 4,856,519 | 8/1989 | Teves . | |
| 5,021,060 | 6/1991 | Lu . | |
| 5,033,864 | 7/1991 | Lasecki et al. . | |
| 5,059,215 | 10/1991 | Girau . | |
| 5,284,490 | 2/1994 | Green . | |
| 5,292,335 | 3/1994 | Shin . | |
| 5,334,218 | 8/1994 | Johnson . | |
| 5,522,847 | 6/1996 | Kalis et al. . | |
| 5,540,719 | 7/1996 | Covelli-Ingwell et al. . | |

* cited by examiner

*Primary Examiner*—Michael Buiz
*Assistant Examiner*—Vy Q. Bui
(74) *Attorney, Agent, or Firm*—Vanophem Meehan & Vanophem, P.C.

(57) ABSTRACT

A pacifier having a bulbous nipple mounted to a body portion. The body portion houses a motion generator that causes vibrations that pass through the nipple to the baby's gums thereby soothing the gums. The vibrations are generated by an unbalanced weight that is set into movement by a motor or a system of gears. A switch activates the pacifier. In the geared embodiment, the motion generator is actuated by winding the gears. A sound generator can be used to generate a melody in addition to the vibrations.

5 Claims, 2 Drawing Sheets

PACIFIER WITH MOTION/SOUND GENERATOR

BACKGROUND OF THE INVENTION

1. Field of the Invention

The apparatus of the present invention relates to infant pacifiers. More particularly, the present invention relates to infant pacifiers that soothe a baby by generating motion and sound.

2. Description of the Prior Art

A pacifier device is designed to soothe a baby, and its effectiveness is measured by the comfort of the baby. However, a pacifier's effectiveness is also measured by the comfort of the parents. A variety of modifications have been made to infant pacifiers in an attempt to pacify the parents as well as the baby.

Pacifiers have been equipped with temperature indicators that indicate the baby's body temperature to a concerned parent without having to wake the baby to measure body temperature. In U.S. Pat. No. 5,021,060 to Lu, a pacifier incorporating a heat sensing plate having a visual display is used to indicate the baby's temperature. The pacifier contains a heat conducting liquid that is warmed by the baby's body temperature. When the baby's temperature rises above a predetermined level, the heat conducting liquid activates a battery operated alarm notifying the parents of the baby's fever.

U.S. Pat. No. 5,033,864 to Lasecki et al. works on a similar principle as U.S. Pat. No. 5,021,060 in that a warning signal is provided when the baby's body temperature rises above a certain predetermined level. The '864 reference relies on a radio signal generated by the pacifier unit that is sent to a remote receiver unit. The remote receiver unit sounds an alarm and sets off indicator lights when the baby has a temperature above the predetermined level.

In an attempt to amuse the viewer of the pacifier, U.S. Pat. No. 5,522,847 to Kalis et al. discloses a pacifier that is equipped with light emitting diodes to highlight a specific feature on the face cover of the pacifier.

The above described pacifiers are designed to pacify the baby by merely sucking the pacifier, and to comfort the baby's parents, or in the case of the Kalis et al. reference, to amuse someone who is viewing the pacifier. The temperature indicators and the light emitting diodes do not provide any soothing benefit to the baby other than the comfort of sucking on the pacifier.

In addition to the comfort obtained by sucking on the pacifier, sound has been added to pacifiers to amuse a baby. U.S. Pat. Nos. 4,856,519 to Teves and 5,059,215 to Girau disclose pacifiers that utilize a device that makes a noise as the baby sucks on the pacifier. The pacifiers generate a whistle, rattle, jingle or other sound to occupy the baby.

To try to overcome the monotony of a recurring whistle or jingle, melody generators have been added to pacifiers. The musical pacifiers disclosed in U.S. Pat. Nos. 4,554,919 to Hubert and 5,292,335 to Shin each contain a melody generator that is activated by a switch or by the baby's sucking motions. In such a pacifier, a variety of melodies have been implemented.

However, as any parent knows, the noises generated by a pacifier may amuse the baby, but the noises tend to aggravate the parents, or others around the baby after a certain amount of time. So while the baby may be amused, everyone else is confronted by a recurring whistle, jingle, rattle or melody played over and over again. Eventually, the novelty of a noise maker will also wear off for the baby.

Another problem associated with a baby's discomfort, and likewise the parents'discomfort, is teething. The pain that babies experience during teething can be unbearable, not only for the babies, but their parents as well. Teethers have been designed for a baby to chew on in an attempt to soothe the pain and discomfort associated with teething. U.S. Pat. No. 1,586,499 to Worth discloses a teething apparatus designed to stimulate circulation around the teeth to better nourish and strengthen the teeth.

U.S. Pat. No. 3,283,758 to Killebrew combines an infant teether with a noise making device thereby providing something for the baby to chew on to relieve pain and at the same time make some noise to amuse the baby. The '758 reference discloses a soft sponge material that is covered by an elongated tubular piece of elasticized material. A noisemaker is secured at each end of the soft sponge. In operation, the teether is tied around the baby's wrist and the baby chews on the soft sponge. As the baby moves the teether, the noisemakers on either side of the soft sponge generate a sound that entertains the baby.

U.S. Pat. Nos. 5,284,490 to Green and 5,334,218 to Johnson each disclose a teether having resilient exercise projections that the baby can chew on. The '490 reference discloses a structure incorporating a first teething member and a second teething member mounted at opposite ends of a handle. The teething members have resilient exercise projections. The '218 reference combines a pacifier/teether combination having a nipple member and a semi-circular teething member sized and configured to conform to the shape of the alveolar ridge of an infant. However, the above described devices relieve teething pain by requiring the baby to chew on the device. Merely sucking on the device will not relieve the baby's teething pain.

Accordingly, there is a need for a pacifier that effectively soothes not only the baby, but the baby's parents as well. What is needed is a pacifier that serves to effectively soothe the pain and discomfort associated with teething that pacifies a baby by merely sucking on the pacifier.

SUMMARY OF THE INVENTION

The present invention is an apparatus for soothing a baby that also relieves the pain and discomfort associated with teething. The apparatus is a pacifier having a bulbous nipple mounted to a body portion. The body portion houses a motion generator that causes vibrations to pass through the nipple to the baby's gums thereby soothing the gums.

The motion generator is an unbalanced weight driven by a small DC motor activated by a switch. The motor has a power supply that can be mounted internal or external to the body portion of the pacifier. For an external power supply, a conductor provides the coupling between the motor and the power supply and also serves as a tether for the pacifier. The external power supply can be provided with a casing and a clip mounted external to the casing for attachment to the baby's clothing or another article. If the pacifier should fall out of the baby's mouth, it will stay attached to the baby by the tether without falling to the ground.

The motion generator may also be a mechanical wind up device that is physically wound up by a crank in the form of a loop in the end of the pacifier. A spring driven gear system generates the motion necessary to move the unbalanced weight generating vibrations. In such an embodiment, a power supply is not necessary.

It is an object of the present invention to provide an apparatus to soothe and pacify a baby who is teething or otherwise discomforted.

It is another object of the present invention to soothe and pacify a baby through motion generated by the apparatus.

It is yet another object of the present invention to generate the motion by an unbalanced weight located in the body of the apparatus.

It is still another object of the present invention to adjust the speed of the motion generator thereby making the motion variable.

It is a further object of the present invention to provide a tether for attaching the apparatus to the baby's clothing or other article to prevent the apparatus from falling to the ground.

Further objects, features and advantages of the invention will become apparent from a review of the brief description of the figures taken in conjunction with a detailed description of the preferred embodiment that follows.

DETAILED DESCRIPTION OF THE PREFERRED EMBODIMENT

Figure 1:
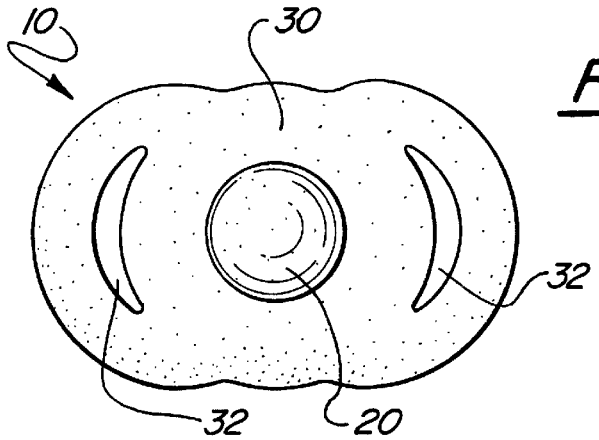
FIG. 1 is a front view of the pacifier of the present invention.

Referring generally to FIGS. 1 through 4, and particularly to FIG. 1 a pacifier 10 of the present invention is shown. The pacifier 10 generally includes a bulbous nipple 20 to be received by an infant's mouth and a body portion 30. The body portion 30 is designed, as presently known in the art, with its size such that the baby is prevented from choking on the pacifier 10.

Included on the body portion 10 are vents 32. The vents 32 allow air to pass through the body portion 30 to maintain a clear airway for the baby to breathe through. The size and shape of the body portion 30 is such that it acts as a guard preventing the baby from drawing the pacifier completely into the baby's mouth where it could obstruct the baby's airway. In the event the pacifier is drawn into the baby's mouth, the vents 32 provide air passages.

Figure 2:
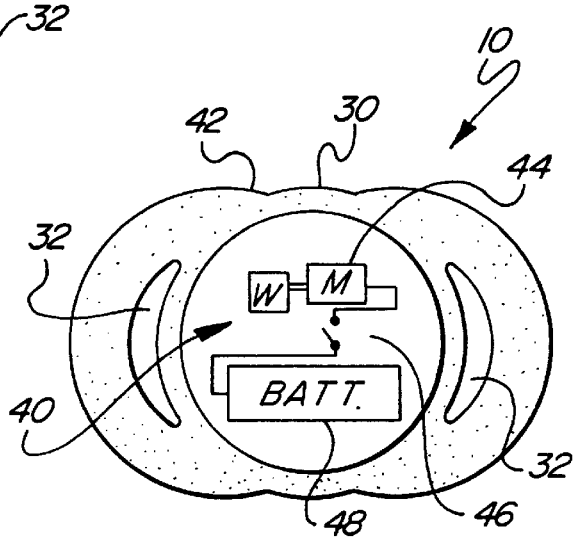
FIG. 2 is a rear view of the pacifier of the present invention showing a block diagram of the circuitry for the motion generator housed in the body of the pacifier.

The body portion 30 houses a motion generator 40, best shown as a schematic in FIG. 2. The motion generator generally includes a power supply 48, a switch 46, a motor 44 and a weight 42. The power supply 48 powers the motor 44 which spins the weight 42.

In the preferred embodiment, the motor 44 is a small 1.5 volt DC motor. The weight 42 is mounted to the motor in an unbalanced manner. When the motor spins the unbalanced weight 42, vibrations are created in the body portion 30 that generate a massaging motion that is transferred to the bulbous nipple 20. The massaging motion of the bulbous nipple 20 soothes the baby's gums merely by being in the baby's mouth. The baby is pacified by sucking on the bulbous nipple 20, and the vibrating action generated by the motion generator 40 is transferred through the bulbous nipple 20 and applied to the gums to alleviate the teething pain.

The switch 46 makes the connection between the power supply 48 and the motor 44. In the preferred embodiment, a rotary switch 46 is used which allows the speed of the motor 44 to be adjusted and varies the speed and intensity of the massaging motion. A cap 50 is removably attached to the body portion 30 for access to the battery 48. The cap 50 covers the motion generator 40 and is secured to the body portion 30 so that it is incapable of being inadvertently removed and potentially swallowed by the baby while preventing inadvertent access to the motor and the associated elements.

Alternatively, the cap 50 may be used to actuate the switch 46. The cap 50 engages the switch 46 and the switch positions are changed by rotating the cap 50.

Figure 3:
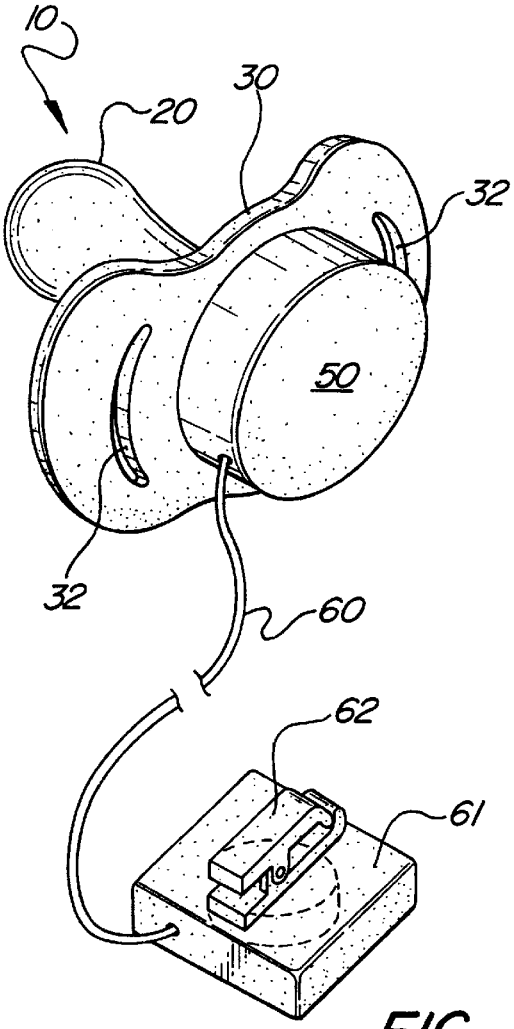
FIG. 3 is a perspective view of the pacifier of the present invention showing a cover for the rear of the pacifier which functions as a switch or crank to operate the motion generator and shows a tether that may function as wiring for an externally mounted battery.

In an alternate embodiment of the pacifier 10 of the present invention, as shown in FIG. 3, the power supply 48 may be wired external to the pacifier. The power supply (not shown in FIG. 3) is external to the pacifier body portion 30 and is enclosed in a casing 61 that also includes a clip 62 mounted on the casing 61. A conductor 60 running from the power supply in the casing to the pacifier 10 connects the power supply to the switch 46 inside the pacifier body portion 30. The conductor 60 doubles as a tether which may be clipped to the infant's clothing or other article and prevents the pacifier from falling to the ground, or keeps it easily accessible when not being used. The conductor 60 is fixed to a predetermined length that is incapable of being wrapped around the baby's neck.

Figure 4:
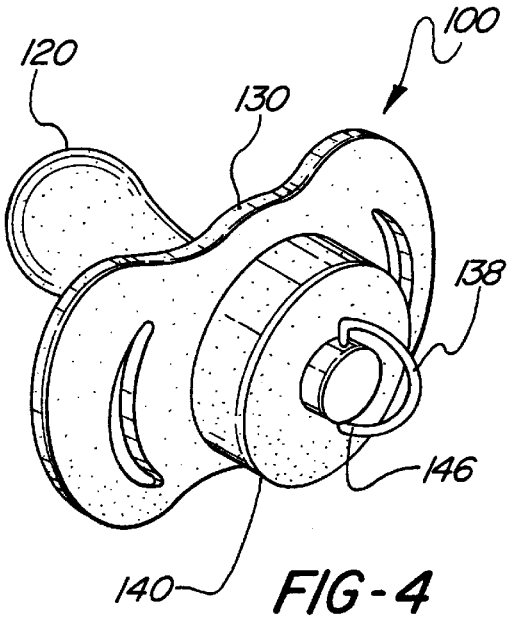
FIG. 4 is a perspective view of an alternate embodiment of the present invention which is mechanically operated.
Figure 5:
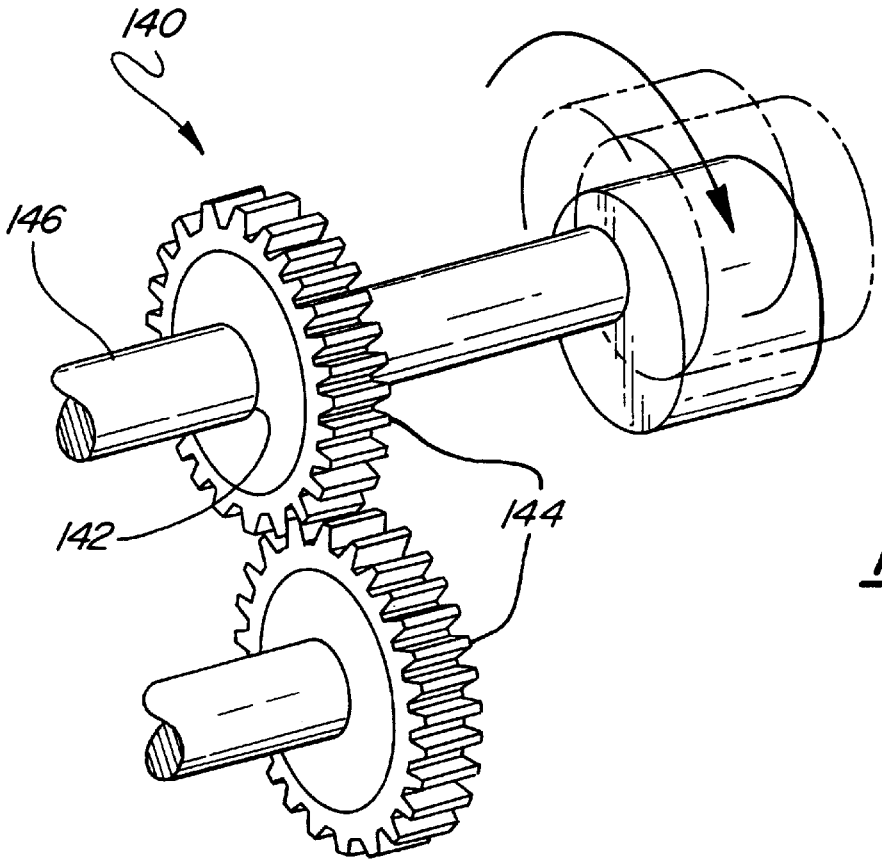
FIG. 5 is a view of the gear mechanics for the embodiment shown in FIG. 4.

In another embodiment of the pacifier 100, shown in FIGS. 4 and 5, the unbalanced weight 42 (not shown in FIG. 4) is spun by a mechanical wind-up device 140 similar to a device used by a wind-up alarm clock. The pacifier 100 has a bulbous nipple 120 and a body portion 130. The wind-up device 140 is housed within the body portion. The wind-up device 140 generally includes a torsion spring 142 coupled to a series of gears 144, that, in turn, are coupled to the unbalanced weight 42.

A loop 138 mounted to a shaft 146 is provided on the backside of the body portion 130 which is used to wind the torsion spring 142 housed within the body portion 130. The torsion spring 142 is wound as the loop 138 is rotated and, when released, the series of gears 144 rotate to spin the unbalanced weight 42. As the wind-up device 140 spins the unbalanced weight 42, the vibrations are created through the bulbous nipple to soothe the baby.

Figure 6:
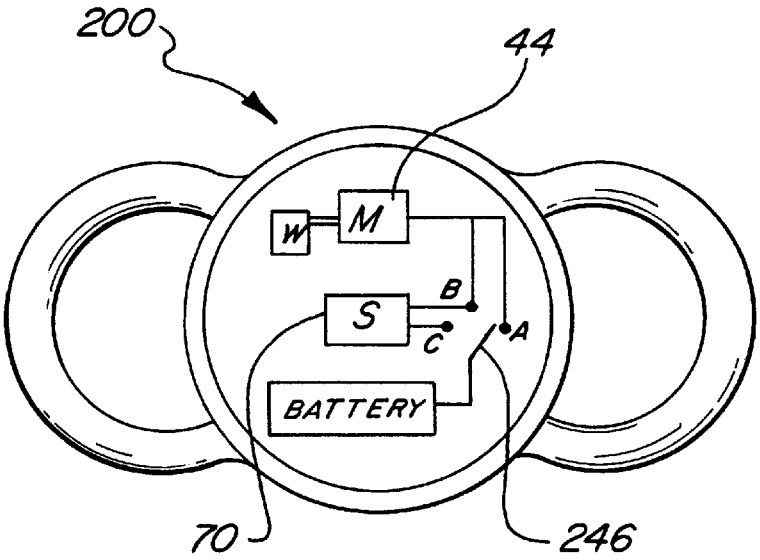
FIG. 6 is a rear view of the pacifier of the present invention showing a block diagram of the circuitry for the sound generator housed in the body of the pacifier.

In yet another embodiment of the pacifier shown in FIG. 6, a sound generator 70 can be added to the pacifier 200 whereby a sound effect, or melody may be played in addition to, or instead of the massaging motion. The sound will occupy the baby and the vibrations will soothe the baby's gums. The switch 246 has multiple positions that determine the output of the pacifier 10. In position A the motor 44 of the motion generator 40 is actuated. In position B the motion generator 40 and sound generators 70 are actuated. And in position C the sound generator 70 alone is actuated.

While the preferred embodiments of the invention have been described in detail in the foregoing detailed description and are shown in the attached drawings, one skilled in the art is aware of alternatives to the preferred embodiment which are defined by the above description and drawings when taken in conjunction with the following claims.

What is claimed is:

1. An infant pacifier comprising:

a nipple;

a body portion fixed to said nipple;

means for generating vibratory motion, said means for generating vibratory motion housed within said body portion, said means for generating vibratory motion further comprising;

a power supply;

a switch means connected to said power supply;

a motor connected to said switch means;

an unbalanced weight coupled to said motor;

means for electrically connecting said power supply, motor and switch means whereby as said motor turns said unbalanced weight creates vibrations that pass through said nipple; and means for generating sound, said sound generating means being housed within said body portion.

2. An infant pacifier as claimed in claim 1 wherein said switch means further comprises a rotary switch.

3. An infant pacifier comprising:

a nipple;

a body portion fixed to said nipple;

an unbalanced weight mounted in said body portion;

a plurality of gears connected to said unbalanced weight;

coil spring means connected to one of said plurality of gears; and a crank member connected to said coil spring means, one end of said crank member mounted external to said body portion, such that as said one end of said crank member winds said coil spring means and is thereafter released, said plurality of gears are rotated and generate movement of said unbalanced weight causing vibrations that are transferred to said nipple.

4. An infant pacifier comprising:

a nipple;

a body portion fixed to said nipple;

means for generating vibratory motion, said means for generating vibratory motion housed within said body portion, said means for generating motion further comprising:

a switch;

a motor connected to said switch;

a weight coupled to said motor, said weight being unbalanced, whereby as said motor spins said weight creates vibrations that pass through said nipple;

a power supply mounted external to said body portion;

a conductor connecting said power supply and said switch, a casing surrounding said power supply, and a clip externally mounted to said casing, said conductor running between said power supply and said switch.

5. An infant pacifier as claimed in claim 4 further comprising means for generating sound said sound generating means being housed within said body portion.

* * * * *

UNITED STATES PATENT AND TRADEMARK OFFICE

CERTIFICATE OF CORRECTION

PATENT NO. : 6,193,742 B1
DATED : February 27, 2001
INVENTOR(S) : David J. Moriarty It is certified that error appears in the above-identified patent and that said Letters Patent is hereby corrected as shown below:

Column 5,
Line 8, delete the semi-colon ";" and insert a colon -- : --.

Column 6,
Lines 22 and 23, delete the comma "," and insert a semi-colon -- ; --.
Line 27, after "sound" insert a comma -- , --.

Signed and Sealed this

Eighteenth Day of June, 2002

*Attest:*

*Attesting Officer*

JAMES E. ROGAN
*Director of the United States Patent and Trademark Office*